US009580860B2

(12) United States Patent
Bellinger et al.

(10) Patent No.: US 9,580,860 B2
(45) **Date of Patent: *Feb. 28, 2017**

(54) METHOD FOR OPERATING A CLOTHES DRYER USING LOAD TEMPERATURE DETERMINED BY AN INFRARED SENSOR

(75) Inventors: Ryan R. Bellinger, Saint Joseph, MI (US); Fredrick E. Chernetski, Saint Joseph, MI (US); Christopher J. Woerdehoff, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 2091 days.

This patent is subject to a terminal disclaimer.

(21) Appl. No.: 12/641,480

(22) Filed: Dec. 18, 2009

(65) Prior Publication Data

US 2011/0146101 A1 Jun. 23, 2011

(51) Int. Cl.
*D06F 58/28* (2006.01)

(52) U.S. Cl.
CPC ..... *D06F 58/28* (2013.01); *D06F 2058/2845* (2013.01); *D06F 2058/2896* (2013.01)

(58) Field of Classification Search
CPC ..... D06F 58/28; D06F 2058/2845; D06F 2058/2896
USPC ..... 34/497, 499, 380, 389, 427, 491, 526, 34/527, 572
See application file for complete search history.

(56) References Cited

U.S. PATENT DOCUMENTS 4,006,535 A * 2/1977 Nelson ..... 34/572
4,275,508 A * 6/1981 Jones ..... 34/524
5,172,490 A * 12/1992 Tatsumi et al. ..... 34/488
5,245,764 A * 9/1993 Sung ..... 34/550
5,276,978 A * 1/1994 Hopkins et al. ..... 34/550
5,396,715 A 3/1995 Smith
5,560,124 A * 10/1996 Hart et al. ..... 34/493
5,651,192 A * 7/1997 Horwitz ..... 34/529
5,755,041 A 5/1998 Horwitz
6,047,486 A * 4/2000 Reck et al. ..... 34/491
6,122,840 A * 9/2000 Chbat et al. ..... 34/496
6,158,148 A * 12/2000 Krausch ..... 34/497
6,401,357 B1 6/2002 Smith et al.
6,519,871 B2 * 2/2003 Gardner et al. ..... 34/497
6,715,216 B1 4/2004 Salameh et al.
6,751,888 B2 * 6/2004 Lueckenbach ..... 34/595
6,784,997 B2 * 8/2004 Lorenz et al. ..... 356/429
6,840,069 B2 1/2005 France et al.
7,020,982 B2 * 4/2006 Park et al. ..... 34/496
7,043,855 B2 * 5/2006 Heilman et al. ..... 34/389
7,257,905 B2 8/2007 Guinibert et al.
7,448,145 B2 * 11/2008 Kim ..... 34/562
7,644,513 B2 * 1/2010 Bae et al. ..... 34/445
8,015,726 B2 * 9/2011 Carow et al. ..... 34/381
(Continued)

FOREIGN PATENT DOCUMENTS

DE 19961459 A1 7/2001
DE 102006025952 A1 12/2007
(Continued)

OTHER PUBLICATIONS

German Search Report for corresponding DE102010017232, Dec. 22, 2011.

*Primary Examiner* — Jiping Lu

(57) ABSTRACT

A method for controlling a clothes dryer based on a characteristic of the load determined by temperatures provided by an infrared sensor.

2 Claims, 12 Drawing Sheets

(56) References Cited

U.S. PATENT DOCUMENTS

| | | | | |
|---|---|---|---|---|
| 2004/0006886 | A1* | 1/2004 | Lee et al. | 34/82 |
| 2005/0086826 | A1 | 4/2005 | Frushtick | |
| 2006/0260064 | A1 | 11/2006 | Luckman et al. | |
| 2007/0193056 | A1 | 8/2007 | Switalski | |
| 2007/0214678 | A1* | 9/2007 | Son et al. | 34/446 |
| 2008/0120868 | A1 | 5/2008 | Morrison et al. | |
| 2009/0044422 | A1 | 2/2009 | Moschuetz et al. | |
| 2009/0126220 | A1* | 5/2009 | Nawrot et al. | 34/497 |
| 2009/0223082 | A1* | 9/2009 | Baek et al. | 34/497 |
| 2009/0272004 | A1* | 11/2009 | Chernetski et al. | 34/389 |
| 2010/0050464 | A1* | 3/2010 | Krzelowski et al. | 34/380 |
| 2011/0308103 | A1* | 12/2011 | Bellinger et al. | 34/497 |

FOREIGN PATENT DOCUMENTS

| | | | |
|---|---|---|---|
| DE | 102008008797 | A1 | 8/2009 |
| EP | 0312065 | A1 | 4/1989 |
| EP | 0679754 | B1 | 11/1995 |
| EP | 1279760 | B1 | 1/2003 |
| EP | 1983086 | A2 | 10/2008 |
| EP | 2022893 | A2 | 2/2009 |
| FR | 2894996 | A1 | 6/2007 |
| JP | 5177095 | A | 7/1993 |
| JP | 5200194 | A | 8/1993 |
| JP | 6126099 | A | 5/1994 |
| JP | 2009078059 | A | 4/2009 |
| JP | 2009131786 | A | 6/2009 |
| WO | 2007/057360 | A1 | 5/2007 |
| WO | 2008/148844 | A2 | 12/2008 |

* cited by examiner

METHOD FOR OPERATING A CLOTHES DRYER USING LOAD TEMPERATURE DETERMINED BY AN INFRARED SENSOR

BACKGROUND OF THE INVENTION

Laundry treating appliances, such as clothes dryers, refreshers, and non-aqueous systems, may have a configuration based on a rotating drum that defines a treating chamber in which laundry items are placed for treating. The laundry treating appliance may have a controller that implements a number of pre-programmed cycles of operation having one or more operating parameters.

In some clothes dryers, one or more operating parameters may be set based on the temperature inside the treating chamber and/or the temperature of the exhaust air. This temperature is assumed to be the same as the temperature of the load of laundry; however, this is most often not the case, leading to poor performance of the clothes dryer.

In other clothes dryers, one or more operating parameters may be set based on the moisture content of the load of laundry. Sensors known as moisture strips are located in the treating chamber and detect the conductivity, and therefore the moisture, of the laundry during a cycle of operation. Moisture strips can be susceptible to electronic interference and other environmental conditions, such as differences in water characteristics. With steam- and chemistry-dispensing clothes dryers, the amount of steam or treating chemistry dispensed may be imperceptible by moisture strips. Any of these circumstances may cause the moisture strips to misread the moisture content of the load of laundry.

Several events can occur within a clothes dryer that prevents the drum from rotating. For example, a broken drive belt, a seized drive motor, an open thermal protector in the drive motor, or an object wedged between a baffle and a bulkhead can all prevent the drum from rotating. Typical clothes dryers do not have any way of determining if the drum is not rotating when it should be rotating, and may continue to supply heated air to the load of laundry after a failure. Without rotation, the load of laundry is unlikely to dry evenly.

SUMMARY OF THE INVENTION

A method for a clothes dryer having a rotatable drum defining a treating chamber and an infrared temperature sensor directed toward the treating chamber. The method according to one embodiment of the invention includes rotating the drum with a load of laundry in the treating chamber, taking a plurality of temperature readings over time of the load of laundry with the infrared sensor while the drum is rotating, determining a temperature variation in the plurality of temperature readings, and using the temperature variation to determine a characteristic of the load of laundry and/or to control the operation of the clothes dryer.

DESCRIPTION OF EMBODIMENTS OF THE INVENTION

Figure 1:
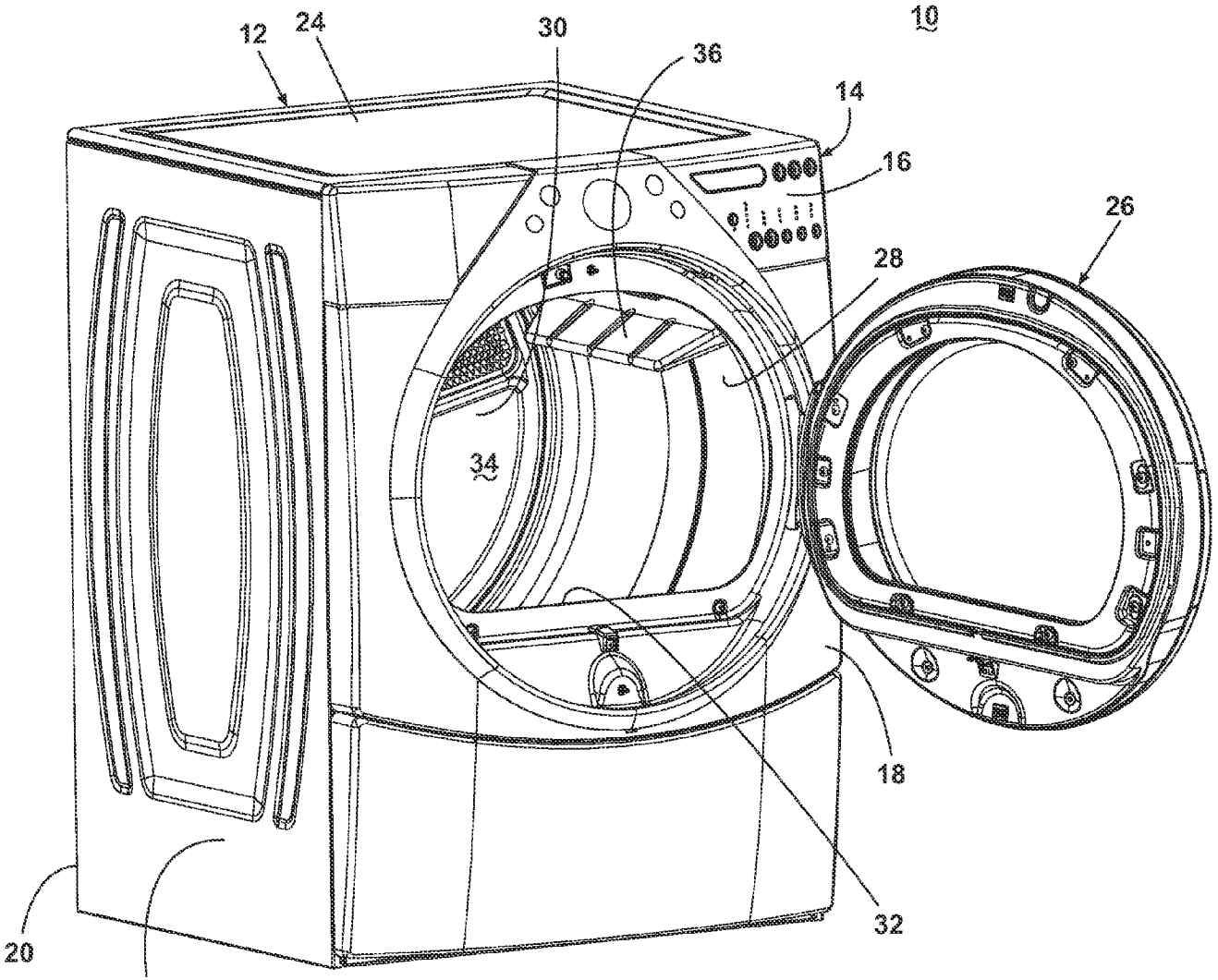
FIG. 1 is a front perspective view of a laundry treating appliance according to one embodiment of the invention in the form of a clothes dryer with a treating chamber.

FIG. 1 illustrates one embodiment of a laundry treating appliance in the form of a clothes dryer 10 according to the invention. While the laundry treating appliance is illustrated as a clothes dryer 10, the laundry treating appliance according to the invention may be another appliance which performs a cycle of operation on laundry, non-limiting examples of which include a combination washing machine and dryer; a tumbling or stationary refreshing/revitalizing machine; an extractor; a non-aqueous washing apparatus; and a revitalizing machine. The clothes dryer 10 described herein shares many features of a traditional automatic clothes dryer, which will not be described in detail except as necessary for a complete understanding of the invention.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation. The cabinet 12 may be defined by a front wall 18, a rear wall 20, and a pair of side walls 22 supporting a top wall 24. A door 26 may be hingedly mounted to the front wall 18 and may be selectively moveable between opened and closed positions to close an opening in the front wall 18, which provides access to the interior of the cabinet 12.

A rotatable drum 28 may be disposed within the interior of the cabinet 12 between opposing stationary rear and front bulkheads 30 and 32, which collectively define a drying or treating chamber 34 having an open face that may be selectively closed by the door 26. The drum 28 may include at least one baffle or lifter 36. In most clothes dryers, there are multiple lifters. The lifters 36 may be located along the inner surface of the drum 28 defining an interior circumference of the drum 28. The lifters 36 may facilitate movement of laundry within the drum 28 as the drum 28 rotates.

Figure 2:
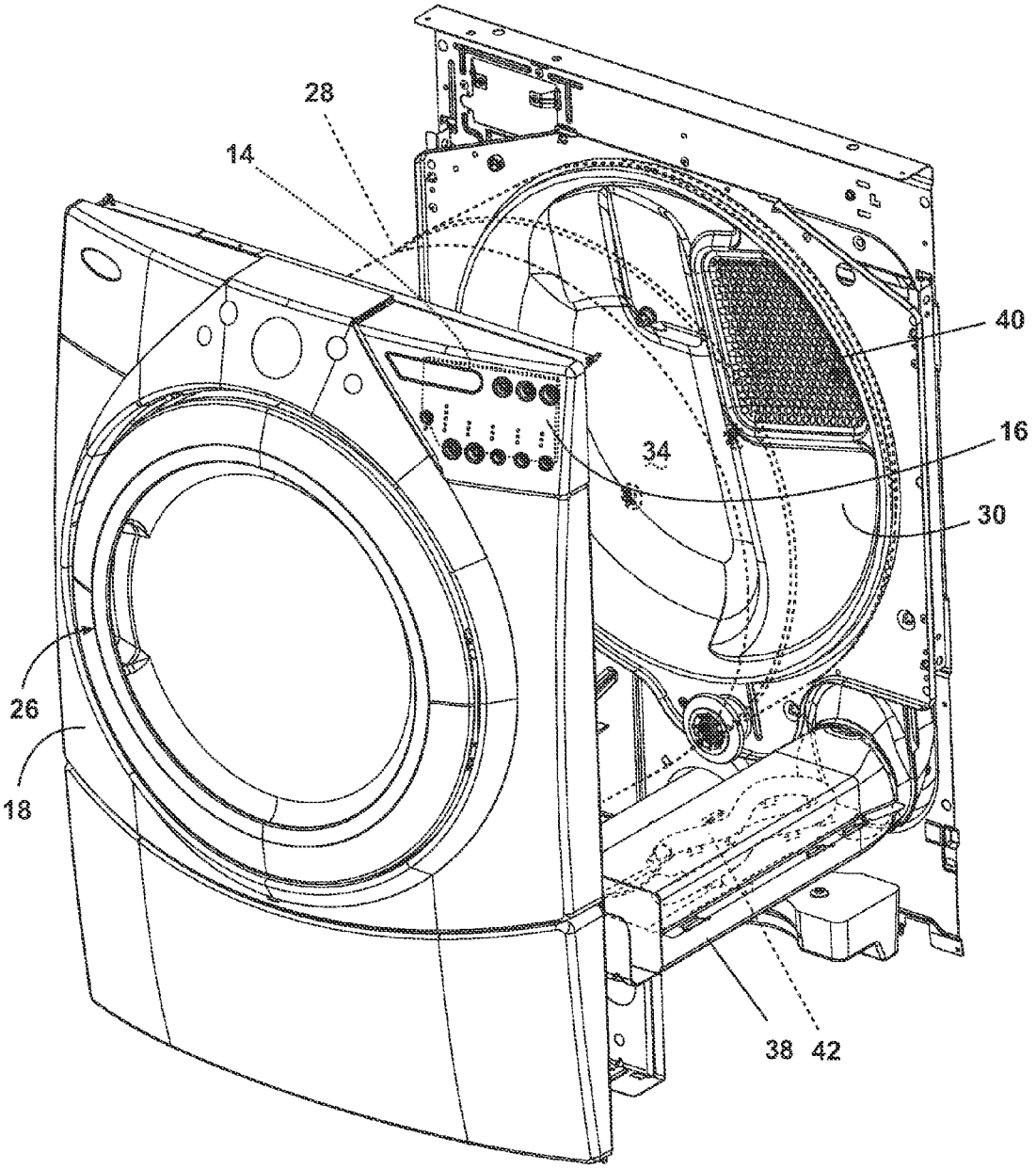
FIG. 2 is a front partial perspective view of the clothes dryer of FIG. 1 with portions of the cabinet removed for clarity.

Referring to FIG. 2, an air flow system for the clothes dryer 10 according to one embodiment of the invention will now be described. The air flow system supplies air to the treating chamber 34 and then exhausts air from the treating chamber 34. The air flow system may have an air supply portion that may be formed in part by an inlet conduit 38, which has one end open to the ambient air and another end fluidly coupled to an inlet grill 40, which may be in fluid communication with the treating chamber 34. A heating element 42 may lie within the inlet conduit 38 and may be operably coupled to and controlled by the controller 14. If the heating element 42 is turned on, the supplied air will be heated prior to entering the drum 28.

Figure 3:
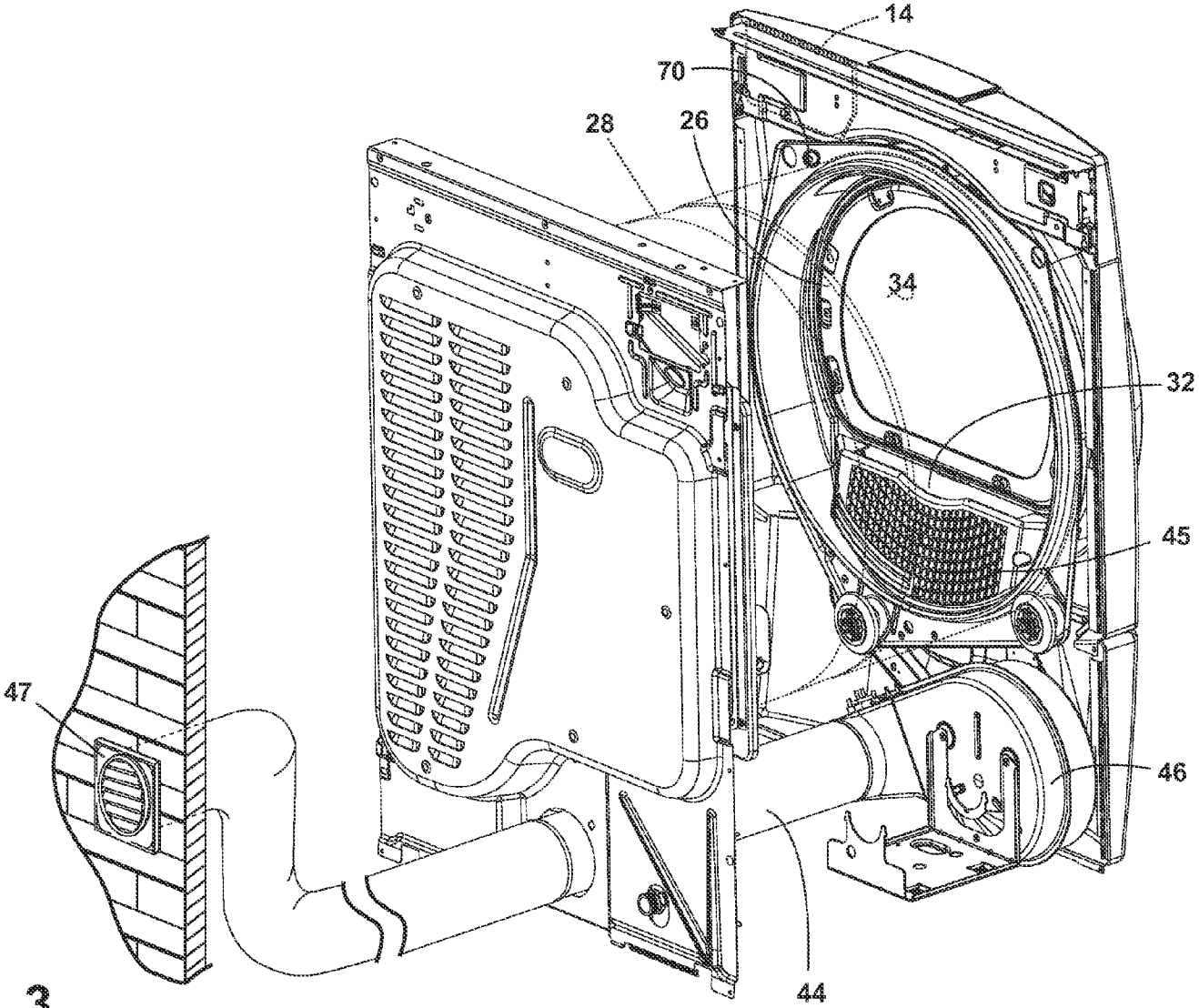
FIG. 3 is rear partial perspective view of the clothes dryer of FIG. 1 with portions of the cabinet removed for clarity.

Referring to FIG. 3, the air supply system may further include an air exhaust portion that may be formed in part by an exhaust conduit 44 and lint trap 45, which are fluidly coupled by a blower 46. The blower 46 may be operably coupled to and controlled by the controller 14. Operation of the blower 46 draws air into the treating chamber 34 and exhausts air from the treating chamber 34 through the exhaust conduit 44. The exhaust conduit 44 may be fluidly coupled with a household exhaust duct 47 for exhausting the air from the treating chamber 34 to the outside environment.

Figure 4:
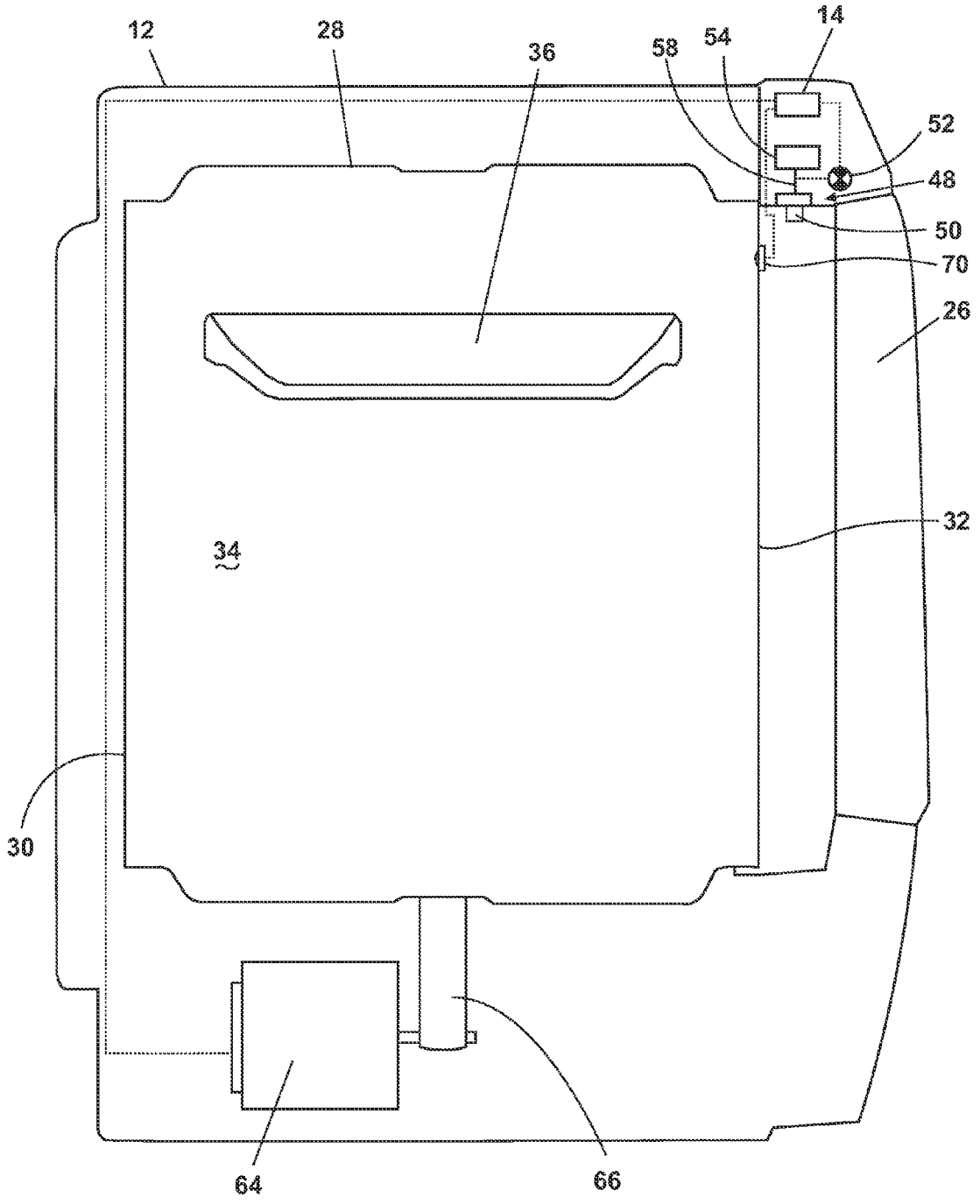
FIG. 4 is a schematic side view of the clothes dryer of FIG. 1 having an infrared temperature sensor for determining the temperature of the treating chamber and/or of a load of laundry within the treating chamber.

Referring to FIG. 4, the clothes dryer 10 may optionally have a dispensing system 48 for dispensing treating chemistries, including without limitation water or steam, into the treating chamber 34, and thus may be considered to be a dispensing dryer. The dispensing system 48 may include a reservoir 54 capable of holding treating chemistry and a dispenser 50 that fluidly couples with the reservoir 54 through a dispensing line 58. The treating chemistry may be delivered to the dispenser 50 from the reservoir 54, and the dispenser 50 may dispense the chemistry into the treating chamber 34. The dispenser 50 may be positioned to direct the treating chemistry at the inner surface of the drum 28 so that laundry may contact and absorb the chemistry, or to dispense the chemistry directly onto the laundry in the treating chamber 34. The type of dispenser 50 is not germane to the invention. A chemistry meter 52 may electronically couple, through a wired or wireless connection, to the controller 14 to control the amount of treating chemistry dispensed.

As is typical in a clothes dryer, the drum 28 may be rotated by a suitable drive unit, which is illustrated as a motor 64 and a coupled belt 66. The motor 64 may be operably coupled to the controller 14 to control the rotation of the drum 28 to complete a cycle of operation. Other drive mechanisms, such as direct drive, may also be used.

The clothes dryer 10 may also have a treating chamber temperature sensor in the form of an infrared (IR) sensor 70 to determine the temperature of the treating chamber 34 and/or of the load of laundry within the treating chamber 34. The IR sensor 70 measures the IR radiation of objects in its field of view; as the IR radiation increases, so does the object's temperature. One example of a suitable IR sensor 70 is a thermopile. The IR sensor 70 may be located on either of the rear or front bulkhead 30, 32 or in the door 26, and may be aimed toward an expected location of a load of laundry within the treating chamber 34. As illustrated, the IR sensor 70 is located in a top portion of the front bulkhead 32 and is aimed generally downwardly within the treating chamber 34. It may be readily understood that the IR sensors 70 may be provided in numerous other locations depending on the particular structure of the clothes dryer 10 and the desired position for obtaining a temperature reading.

Figure 5:
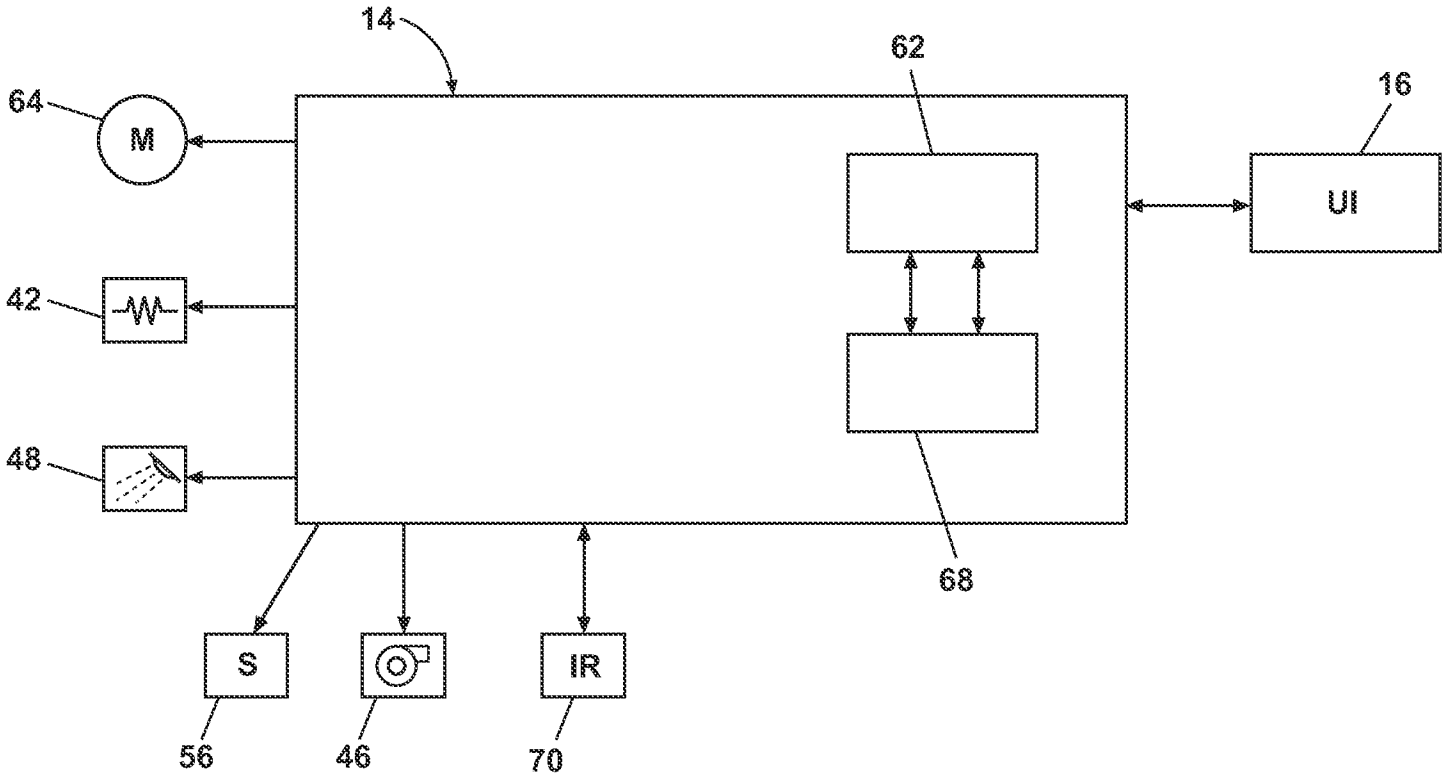
FIG. 5 is a schematic representation of a controller for controlling the operation of one or more components of the clothes dryer of FIG. 1.

As illustrated in FIG. 5, the controller 14 may be provided with a memory 62 and a central processing unit (CPU) 68. The memory 62 may be used for storing the control software that may be executed by the CPU 68 in completing a cycle of operation using the clothes dryer 10 and any additional software. The memory 62 may also be used to store information, such as a database or table, and to store data received from the one or more components of the clothes dryer 10 that may be communicably coupled with the controller 14.

The controller 14 may be communicably and/or operably coupled with one or more components of the clothes dryer 10 for communicating with and controlling the operation of the component to complete a cycle of operation. For example, the controller 14 may be coupled with the heating element 42 and the blower 46 for controlling the temperature and flow rate through the treatment chamber 34; the motor 64 for controlling the direction and speed of rotation of the drum 28; the dispensing system 48 for dispensing a treatment chemistry during a cycle of operation; and the user interface 16 for receiving user selected inputs and communicating information to the user.

The controller 14 may also receive input from various sensors 56, which are known in the art and not shown for simplicity. Non-limiting examples of sensors 56 that may be communicably coupled with the controller 14 include: an inlet air temperature sensor, an exhaust air temperature sensor, a moisture sensor, an air flow rate sensor, a weight sensor, and a motor torque sensor.

The controller 14 may also be coupled with the IR sensor 70 to receive temperature information from the IR sensor 70. The temperature readings may be sent to the controller 14 and analyzed using analysis software stored in the controller memory 62 to determine a temperature of a load of laundry within the drum 28. The controller 14 may use the determined load temperature to set one or more operating parameters of at least one component with which the controller 14 is operably coupled with to complete a cycle of operation.

The previously described clothes dryer 10 provides the structure necessary for the implementation of the method of the invention. Several embodiments of the method will now be described in terms of the operation of the clothes dryer 10. The embodiments of the method function to automatically determine the temperature of a load of laundry and control the operation of the clothes dryer 10 based on the determined load temperature.

The temperature of a load of laundry may be determined by using the IR sensor 70 to obtain multiple temperature readings over time of the contents, i.e. the load of laundry, of the drum 28 as the drum 28 is rotating. The load temperature may then be used to control the operation of the clothes dryer 10.

Controlling the operation of the clothes dryer 10 based on the determined load temperature may include setting at least one operating parameter of a cycle of operation including a rotational speed of the drum 28, a direction of rotation of the drum 28, a temperature in the treating chamber 34, which may include changing a temperature or heating profile, an air flow through the treating chamber 34, which may include changing the blower speed or profile, an energy profile for the cycle of operation, which may include determining the energy needed to complete the cycle of operation, a cycle or phase time, which may include updating a display on the user interface 16 with the time to complete the cycle of operation or a cycle phase, an operation of the IR sensor 70, an algorithm used by the controller 14, a type of treating chemistry, an amount of treating chemistry, a start or end of cycle condition and a start or end cycle step condition.

Setting a start or end of cycle condition may include determining when to start or end a cycle of operation. This may include signaling the controller 14 to immediately start or end a cycle of operation or setting a time at which to start or end a cycle of operation.

Setting a start or end of cycle step condition may include determining when to start a step or phase within a given operating cycle or when to end a step within a given operating cycle. This may include signaling the controller 14 to immediately transition from one cycle step to another or setting a time at which to transition from one step to another within a given operating cycle. Examples of cycle steps include rotation with heated air, rotation without heated air, treatment dispensing and a wrinkle guard step.

Before specific embodiments of the methods are presented, a description of the concepts behind the methods may be constructive. In this discussion, small, medium, and large loads of laundry are referenced; however, it is understood that other qualitative load sizes may be used, including, but not limited to, extra-small and extra-large load sizes. It is also understood that the methods described herein may be adapted for use with quantitative load sizes, including, but not limited to, those based on weight, number of articles, or any combination thereof.

Throughout a cycle of operation in the clothes dryer 10, the temperature of the load of laundry sensed by the IR sensor 70 varies. The temperature variation may exist for several reasons. One may be that the IR sensor 70 has a fixed field of view. The tumbling of the load as the drum 28 rotates results in a continuous change in the amount of laundry and the specific laundry items within the field of view of the IR sensor 70. Not all items of laundry nor all portions of a single item of laundry have the same temperature. Therefore, the temperature sensed by the IR sensor 70 may vary from reading to reading, even if the overall average temperature of the load does not significantly change. The tumbling of the load as the drum 28 rotates also results in a continuous change in the portion of the surrounding drum 28 within the field of view of the IR sensor 70. The temperature of the drum 28 may not always be the same as the temperature of the load of laundry. Collectively, the changing portions of the load and drum 28 in the field of view may cause temperature variations.

Drum rotation may also have an effect on temperature variation. Since tumbling of the load as the drum 28 rotates effects the temperature by changing what is in the field of view of the IR sensor 70, non-movement of the load when the drum 28 is stopped will decrease temperature variation since there is little to no change in the position of the load or drum 28 when the drum 28 is not rotating.

Furthermore, portions of the cycle of operation may have distinctive effects on the temperature of the load. Dispensing a treating chemistry onto a load of laundry may affect the temperature since the treating chemistry is typically at a temperature lower than the temperature of the load, resulting in a cooling of the portion of the load contacted by the treating chemistry. The treating chemistry may also migrate thorough the load to cool additional portions of the load. The treating chemistry may also evaporate resulting in evaporative cooling of that portion of the load. Different portions of the load that have been exposed to the treating chemistry may have a different temperature than those portion of the load that have not, and as these different portions move in and out of the field of view of the IR sensor 70, the temperature will vary. Drying the load of laundry will also affect the temperature. As the load of laundry dries, the temperature of the load becomes more consistent throughout the load, which may lead to less temperature variation.

Figure 6:
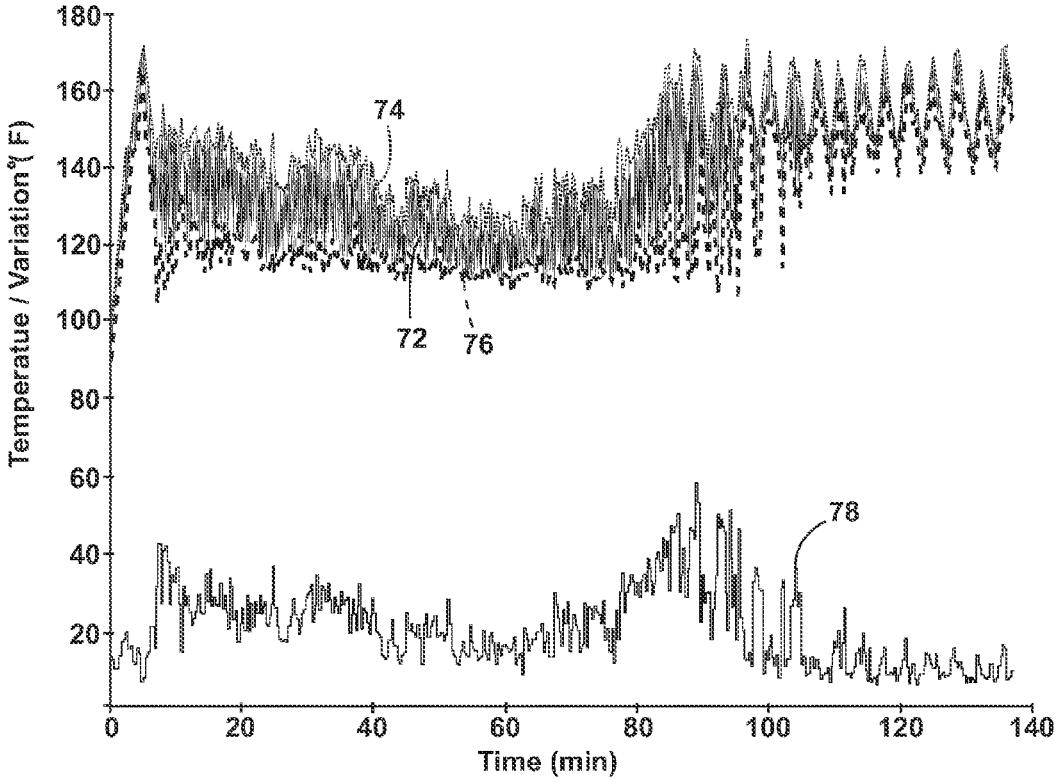
FIG. 6 is a graph of the temperature over time of a load of laundry during tumbling in a clothes dryer, wherein the temperature is measured by an IR sensor.

FIG. 6 shows a graph of the temperature and temperature variation over time of a load of laundry during a cycle of operation in the clothes dryer 10, wherein the temperature is measured by the IR sensor 70. While the graph is compiled using example data from a twelve-article load consisting of three cotton/polyester shirts, three cotton shirts, and six cotton/polyester pants, other loads having varying sizes, fabrics and compilations of articles may follow the same general behavior described below.

In the graph of FIG. 6, line 72 represents the temperature of the load observed by the IR sensor 70. An upper envelope, represented by line 74, and a lower envelope, represented by line 76, can be created for the temperature 72. The upper envelope 74 is determined from the maximum values of temperature 72 and the lower envelope 76 is determined from the minimum values of temperature 72. The upper and lower envelopes 74, 76 may be calculated by monitoring the temperature values within a window of time based on a predetermined period, which may be, for example, 20 seconds. The highest value in the window is used as a data point for the upper envelope 74, while the lowest value in the window is used as a data point for the lower envelope 76. This is done for several windows of time to define multiple data points for the upper and lower envelopes 74, 76. The predetermined period may be adjustable since the maximum and minimum temperature values are dependent on the window of time. In the case of a window of 20 seconds, for example, the IR sensor 70 may observe multiple tumbles of the load within its field of view and may have a higher chance of reading the temperature of the hottest area of the load that tumbled. However, if the window is smaller, for example if the window is 0.5 seconds or less, the IR sensor 70 may only be able to read the temperature of the load at a specific point during the tumble pattern since the drum 28 may not make a full rotation in that time. The difference between the upper and lower envelopes 74, 76 is the temperature variation for the load over time, and is represented by line 78.

Figure 7:
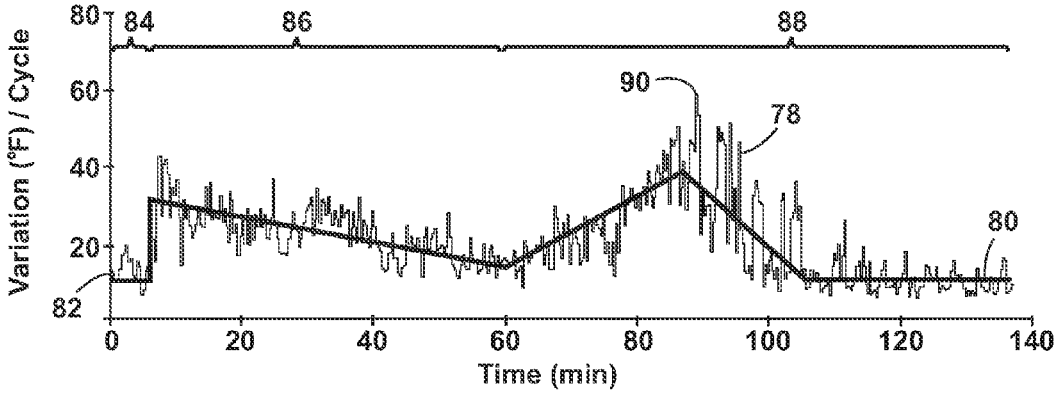
FIG. 7 is a graph comparing the temperature variation from FIG. 6 with a cycle of operation over time.

FIG. 7 shows a graph of the temperature variation 78 over time from FIG. 6 throughout a cycle of operation, represented by line 80. The temperature variation 78 is determined by subtracting corresponding data points from the upper and lower envelopes 74, 76 and is therefore the difference between the maximum and minimum temperature values over each window of time used to calculate the upper and lower envelopes 74, 76. Thus, the temperature variation 78 shown in FIG. 6 and FIG. 7 is the difference in two temperature readings and not an actual temperature.

In the particular cycle of operation used to compile this data, there is a brief (approximately 10 seconds) initial spray phase 82 of treating chemistry at the start of the cycle, followed by a warm-up phase 84, a dispensing phase 86, and a drying phase 88. The initial spray phase 82 is not significant enough to affect the temperature of the load, so there is a relatively steady value in the temperature variation 78 during the warm-up phase 84. When the dispensing phase 86 begins, at approximately 4 minutes into the cycle of operation, there is a sharp increase in the temperature variation 78. One reason for this behavior is that articles that have not yet been wetted by the treating chemistry have a higher temperature than articles that have been wetted by the treating chemistry, and are therefore subject to some evaporative cooling. The increase in the temperature variation 78 may occur after a slight delay due to the time it takes for a laundry item that is in the field of view of the IR sensor 70 to be exposed to the treating chemistry, which is dependent on variables such as, but not limited to, the location of the dispenser 50, the flow rate of the treating chemistry, and the amount of time it takes for the treating chemistry to migrate through the load.

After the sharp increase in temperature variation 78 when the dispensing phase 86 begins, there is a gradual decrease in temperature variation 78 as the load is more uniformly exposed to the treating chemistry. Uniformity of treating chemistry ensures all portions of the articles are covered, which improves the performance of many treating chemistries, especially those for whitening, softness, and wrinkle release. Near the end of the dispensing phase 86, the temperature variation 78 approaches and/or converges with its value during the warm-up phase 84. Therefore, the uniformity of the treating chemistry may be deduced from the temperature variation 78 as the time at which the temperature variation 78 converges with the temperature variation during the warm-up phase. In this way, the temperature variation 78 may be used to determine when to stop the dispensing phase 86.

The dispensing phase 86 stops at approximately 60 minutes into the cycle, and the drying phase 88 begins. During the drying phase 88, there is a gradual overall increase in the temperature variation 78 since the load typically does not dry in a uniform manner. The temperature variation 78 reaches a peak value 90 when the load is at its peak non-uniformity, and thereafter gradually decreases again as the entire load becomes dry. Eventually, near the end of the drying phase 88, the temperature variation 78 approaches and/or converges with its value during the warm-up phase 84. As with the dispensing, the temperature variation 78 may then be used to determine when to stop the drying phase 88.

Figure 8A:
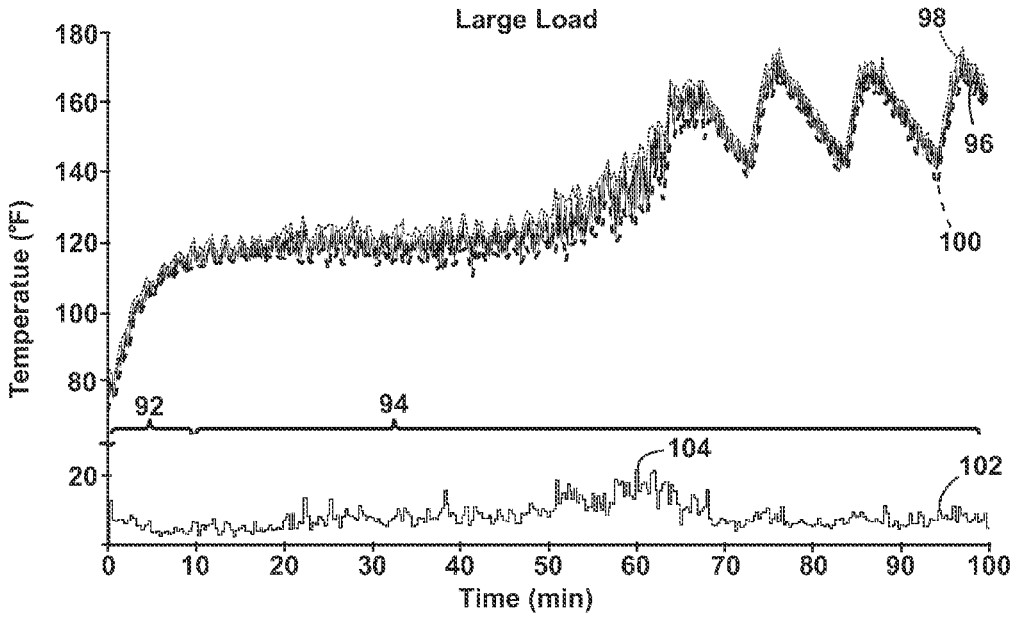
FIGS. 8A, 8B, and 8C are graphs of the temperature over time of a large load of laundry, a small load of laundry, and a mixed load of laundry, respectively during a cycle of operation in a clothes dryer, wherein the temperature is measured by an IR sensor.
Figure 8B:
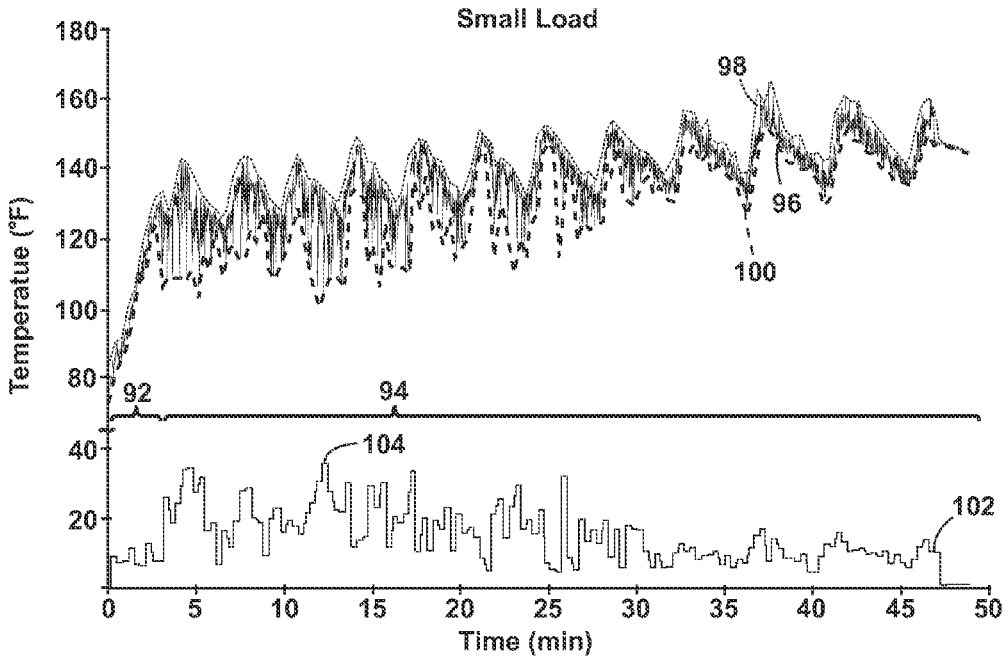
Figure 8C:
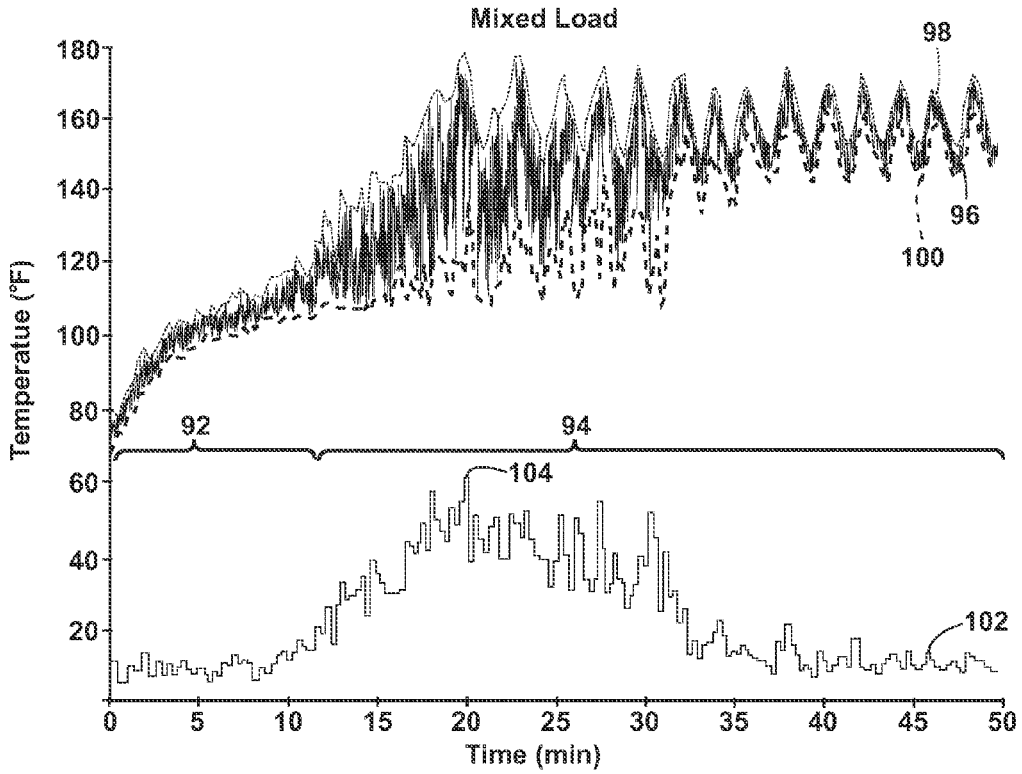

While the cycle of operation shown in FIG. 7 includes a dispensing phase, a similar method can also be used within non-dispensing cycles of operation to determine when to cease the drying phase. FIGS. 8A-8C show graphs of the temperature over time of a large load of laundry, a small load of laundry, and a mixed load of laundry, respectively, during a cycle of operation in the clothes dryer 10, wherein the temperature is measured by the IR sensor 70. In the particular cycle of operation used to compile this data, there is a warm-up phase 92 and a drying phase 94. The example data presented was compiled using a large load (FIG. 8A) consisting of 9 pounds (lbs) of towels, a small load (FIG. 8B) consisting of 1.5 lbs of jeans, and a mixed load (FIG. 8C) consisting of 8 lbs of mixed articles, but other load sizes, weights and compilations of loads are contemplated.

In each graph, line 96 represents the temperature of the load observed by the IR sensor 70. An upper envelope, represented by line 98, and a lower envelope, represented by line 100, can be created for the temperature 96. The upper and lower envelopes 98, 100 may be determined in the same fashion discussed above for the upper and lower envelopes 74, 76 shown in FIG. 6. The difference between the upper and lower envelopes 98, 100 is the temperature variation for the load over time, and is represented by line 102.

For each load, it can generally be observed that the temperature variation 102 is relatively steady during the warm-up phase 92 and increases during the drying phase 94 as the load approaches its peak moisture non-uniformity, indicated at point 104. After the peak value 104, the temperature variation 102 gradually decreases and converges with the its value during the warm-up phase 92, indicating that the load is dry.

Since the same general pattern can be observed for all three loads, an estimate of when to terminate the drying phase 94 can be made by monitoring the initial temperature variation 102, finding the peak value 104 in the temperature variation 102, and monitoring the return of the temperature variation 102 to its initial value after reaching the peak value 104. As the temperature variation 102 converges with the initial value, a determination can be made to cease the drying phase 94. Therefore, an estimate of when to terminate the drying phase 94 can be determined by filtering the temperature signal to find the temperature variation 102, monitoring the initial temperature variation, i.e. the temperature variation during the warm-up phase 92, monitoring the peak value 104 in the temperature variation 102, and monitoring the return of the temperature variation 102 to its initial value.

While the pattern is evident for all three loads, it is more pronounced for some loads than for others. For the large load of FIG. 8A, it can generally be observed that the temperature variation 102 is less than twenty for the majority of the cycle of operation, while the temperature variation 102 approaches or exceeds twenty as the large load approaches its peak moisture non-uniformity at 104. For the small load of FIG. 8B, it can generally be observed that the temperature variation 102 is around ten for the majority of the cycle of operation, while the temperature variation 102 approaches or exceeds twenty as the load approaches its peak moisture non-uniformity at 104. For the mixed load of FIG. 8C, the non-uniformity of drying is more significant since the load itself is non-uniform. As a result, the peak at 104 is much more pronounced. It can be concluded that while the method works well for several different loads, it works especially well for mixed loads.

A method according to one embodiment of the invention may be based at least in part on the concepts shown in FIGS. 6-8C and may use temperature readings from the IR sensor 70 to control the operation of the clothes dryer 10. The method may be incorporated into a cycle of operation for the clothes dryer 10 and may be carried out by the controller 14 using information from the IR sensor 70. Initially or prior to the start of the method, the drum 28 rotates with a load of laundry in the treating chamber 34. A plurality of temperature readings are taken over time by the IR sensor 28 while the drum 28 is rotating. The drum 28 may be rotated at a rotational speed to tumble the load of laundry within the treating chamber 34. Optionally, air may be introduced into the treating chamber 34 to dry to the load of laundry. The air may be heated or unheated. If heated air is supplied, it may be provided for a time sufficient for the load of laundry to reach a uniform temperature. This may be done prior to taking any temperature readings.

A temperature variation in the plurality of temperature readings may then be determined. The temperature variation may be the difference between at least two of the temperature readings. For example, the temperature variation may be the difference between a maximum temperature reading and a minimum temperature reading in the plurality of temperature readings. Alternatively, the difference between multiple temperature readings may be determined to form multiple difference values. For example, the difference between several maximum temperature readings and several minimum temperature readings could be found. Determining the temperature variation may include determining an average of the difference values, and the average may more specifically be determined from an average of the absolute values of the difference values. Alternately, determining of the difference between multiple temperature readings comprises sequentially determining the difference between multiple temperature values. This may include sequentially determining the difference between consecutive temperature readings or between the absolute values of the difference values.

Next, a characteristic of the load of laundry based on the temperature variation may be determined. The determined characteristic may be an intrinsic or extrinsic characteristic. An intrinsic characteristic may be a property of the load of laundry, like moisture content or temperature. One example of an intrinsic characteristic is a fluid uniformity characteristic that is indicative of the uniformity of fluid in the load of laundry. Another example of an intrinsic characteristic is a temperature characteristic, which may be indicative of the average of the aggregate temperature of multiple portions of the load of laundry. An extrinsic characteristic may be related to the state of the laundry, such as whether the load is tumbling or spinning. One example of an extrinsic characteristic is a tumbling characteristic indicative of whether the load of laundry is tumbling in the treating chamber 34.

Finally, the operation of the clothes dryer 10 can be controlled based on the determined characteristic. This may include altering the cycle of operation of the clothes dryer 10 or setting at least one operational parameter of the cycle of operation. To alter the cycle of operation, a cycle phase may be added, deleted, and/or terminated. Examples of cycle phases are a warm-up phase, which may or may not include introduction of heated air, a fluid introduction or dispensing phase, an air introduction phase, a heated air introduction phase, a drying phase, which may or may not include introduction of heated air, and a cool-down phase. If a cycle phase is terminated, the cycle of operation may end or may enter a different cycle phase. For example, if a drying phase is terminated, the introduction of air or at least the heating of the air may be ceased. The cycle of operation may then enter a cool-down phase in which the load of laundry is tumbled, but no heated air is supplied to the treating chamber 34.

In one example of the method, the temperature variation may be used to determine a fluid uniformity characteristic that is indicative of the uniformity of fluid in the load of laundry. Based on the fluid uniformity characteristic, the introduction of fluid onto the load can be controlled. For example, the amount of treating chemistry can be set or a decision to terminate a fluid introduction phase can be made based on the fluid uniformity characteristic. The fluid uniformity characteristic may be repeatedly determined while introducing the fluid onto the load of laundry. When the fluid uniformity characteristic satisfies a predetermined threshold, introduction of fluid onto the load of laundry may be stopped, i.e. the fluid introduction phase may be terminated. The predetermined threshold may be a value indicative of uniform distribution of fluid in the load of laundry. For example, in FIG. 7, as the temperature variation 78 approaches and/or converges with its value during the warm-up phase 84 in the dispensing phase 86, the load is uniformly exposed to the treating chemistry. The value of the temperature variation during the warm-up phase may be set as the predetermined threshold, and used to determine when the load of laundry is uniformly exposed to fluid.

In another example of the method, the temperature variation may be used to determine when to terminate the drying of the load of laundry. When the temperature variation satisfies a predetermined temperature variation threshold, drying may be ceased. For example, in FIGS. 8A-8C, as the temperature variation 102 approaches and/or converges with its value during the warm-up phase 92 in the drying phase 94, the load is dry. The value of the temperature variation during the warm-up phase may be set as the predetermined temperature variation threshold, and used to determine when to terminate drying. Alternately, the temperature variation 102 can be monitored, the peak value 104 may be found. After the peak value 104 is reached, drying of the load of laundry may be terminated when the temperature variation 102 reaches a steady state.

A method according to another embodiment of the invention may also be based at least in part on the concepts shown in FIGS. 6-7 and may use temperature readings from a sensor to uniformly apply fluid onto a load of laundry in the clothes dryer 10. The method may be incorporated into a cycle of operation for the clothes dryer 10 and may be carried out by the controller 14 using information from the sensor. The method includes a reference phase and a fluid introduction phase. The temperature sensor may optionally be the IR sensor 70, and the temperatures readings taken during at least one of the reference phase and fluid introduction phase may be conducted with the IR sensor 70.

During the reference phase, multiple temperature readings may be taken by the sensor while the drum 28 is rotated to tumble the load of laundry. The reference phase may optionally include the introduction of heated air into the treating chamber 34 and may correspond with a warm-up phase of the cycle of operation.

A temperature variation reference value may be determined from the multiple temperature readings taken during the reference phase. The temperature variation reference value may be the difference between at least two of the temperature readings during the reference phase. For example, the temperature variation reference value may be the difference between a maximum temperature reading and a minimum temperature reading in the plurality of temperature readings. The difference between multiple temperature readings may be determined, and the average of the multiple difference values may be set as the temperature reference value. For example, the difference between several maximum temperature readings and several minimum temperature readings could be found.

During the fluid introduction phase, which may be conducted after the reference phase, multiple temperature readings may be taken by the sensor while fluid is introduced onto the load of laundry by the dispensing system 48 and the drum 28 is rotated. A current temperature variation may be determined from the multiple temperature readings. Fluid introduction may be stopped when the current temperature variation satisfies the temperature variation reference value. For example, in FIG. 7, as the temperature variation 78 approaches and/or converges with its value during the warm-up phase 84 in the dispensing phase 86, the load is uniformly exposed to the treating chemistry and fluid introduction can by stopped. The fluid introduction phase may optionally include the introduction of heated air into the treating chamber 34.

During at least part of the fluid introduction phase, the drum 28 may be rotated at a speed to tumble the load of laundry and/or at a speed to satellite the load of laundry. The drum 28 may be alternately rotated between the tumbling speed and the satelliting speed. Tumbling is a condition in which the laundry may be lifted by the rotating drum 28 from a lower position, generally near or at the bottom of the drum 28, to a raised position, above the lower position, where the laundry is no longer being lifted by the drum 28 and falls within the drum 28, generally toward the bottom of the drum 28. Satelliting (also called plastering) is a condition in which the laundry may be held by centrifugal force against the inner surface of the drum 28 as the drum 28 rotates.

The method may further include a drying phase, conducted after the fluid introduction phase, during which multiple temperature readings may be taken by the IR sensor 70 while air is introduced into the treating chamber 34 and the drum 28 is rotated. A current temperature variation may be determined from the multiple temperature readings. The drying phase may be terminated when the current temperature variation satisfies the temperature variation reference value. For example, in FIG. 7, as the temperature variation 78 approaches and/or converges with its value during the warm-up phase 84 in the drying phase 88, the load is dry and drying can by stopped. Air introduced during the drying phase may be heated air, and the termination of the drying phase may optionally include ceasing the introduction of heated air into the treating chamber 34.

Figure 9:
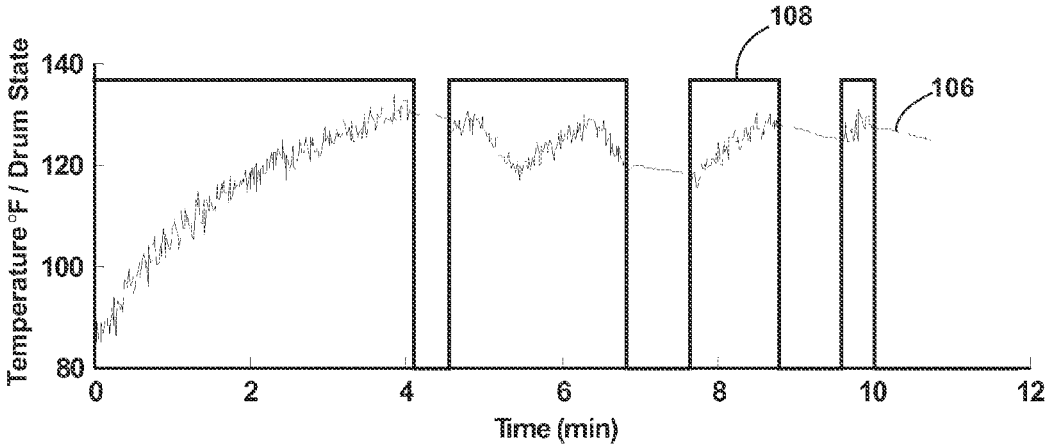
FIG. 9 is a graph of the temperature of a load of laundry and the drum state over time during a cycle of operation in a clothes dryer, wherein the temperature is measured by an IR sensor.

Referring to FIG. 9, rotation of the drum 28 also causes fluctuations in the temperature measured by the IR sensor 70. FIG. 9 shows a graph of the temperature of a load of laundry and the drum state over time during a cycle of operation in the clothes dryer 10, wherein the temperature is measured by the IR sensor 70. In the graph of FIG. 9, line 106 represents the temperature of the load observed by the IR sensor 70 and line 108 represents the drum state, where a drum state 108 of zero indicates that the drum 28 is not rotating, and a drum state 108 other than zero indicates that the drum 28 is rotating. As can be seen, when the drum 28 is not rotating, i.e. when the drum state 108 is zero, the temperature 106 evens out, and there is little to no change in the temperature 106.

Figure 10:
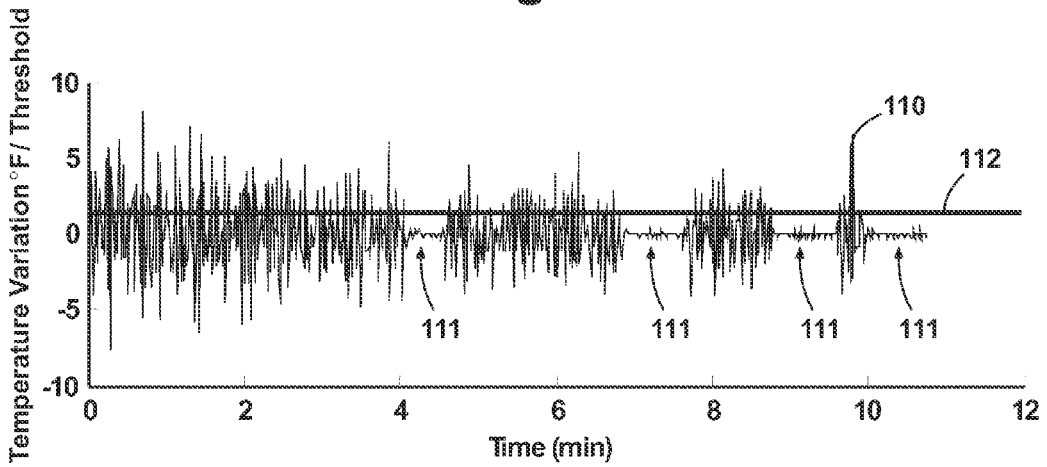
FIG. 10 is a graph of the temperature variation for the temperature of the load of laundry from FIG. 9.

There are several ways in which the temperature readings by the IR sensor 70 may be analyzed to determine if the drum 28 is rotating. In one embodiment, the derivative or difference of consecutive temperature readings can be determined, and this information can be compared to a threshold value to draw a conclusion as to whether the drum 28 is rotating. An example of this embodiment is shown in FIG. 10, where line 110 shows the temperature variation of the temperature 106 shown in FIG. 9. The temperature variation 110 may be determined by finding the difference between consecutive temperature readings. The low, i.e. close to zero, "noise" areas 111 of the graph shown in FIG. 10 indicate the drum rotation has stopped. Therefore, the temperature variation 110 at any given time can be compared to a threshold value 112, whereby the drum 28 is determined to not be rotating if the temperature variation 110 is below the threshold value 112 and the drum 28 is determined to be rotating if the temperature variation 110 is at or above the threshold value 112. The threshold value 112 may be determined from experimental data or may be based on information from the IR sensor 70. It is expected that the threshold value 112 may vary between different dryer platforms and will be selected based on the performance of a given dryer platform to ensure that the threshold value 112 is sufficient to correctly determine whether the drum 28 is rotating.

Figure 11:
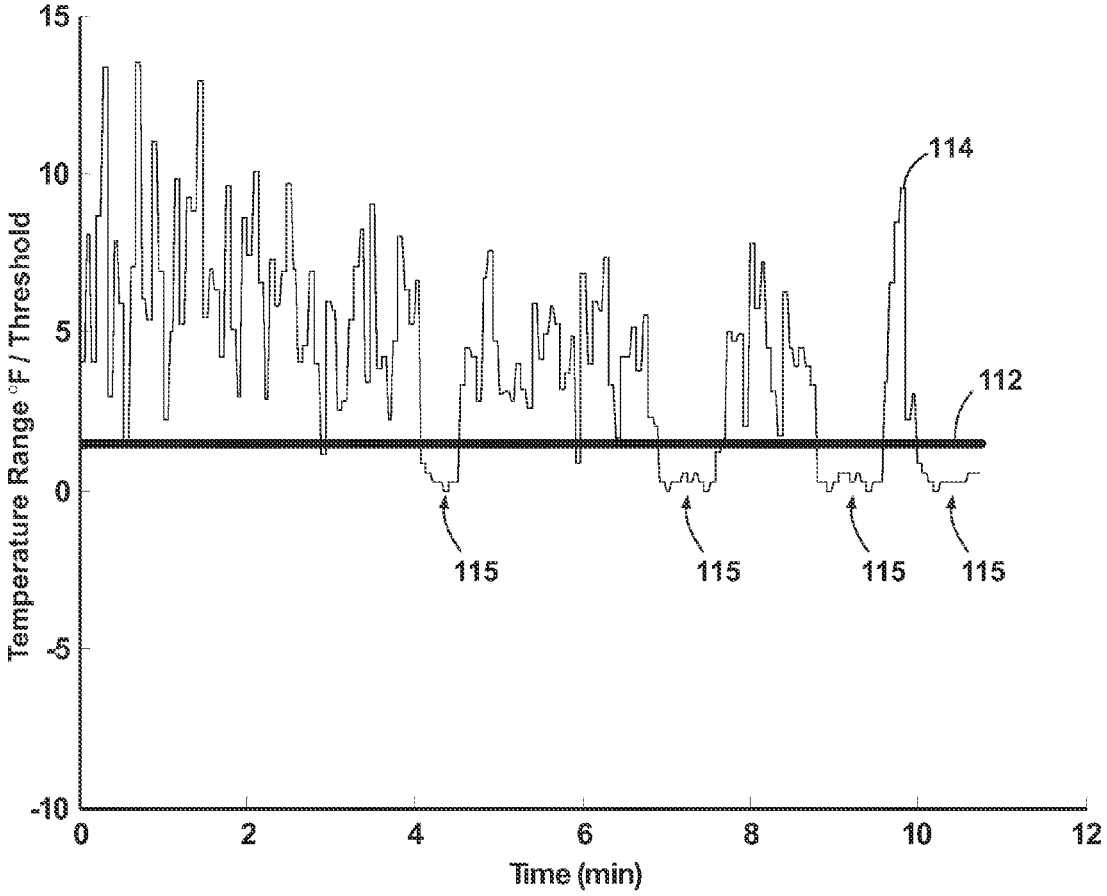
FIG. 11 is a graph of the temperature range for the temperature of the load of laundry from FIG. 9.

In another embodiment, the maximum and minimum temperature variations of a predetermined number of consecutive samples can be determined, and this information can be compared to a threshold value to make a conclusion as to whether the drum 28 is rotating. The minimum temperature variation can be subtracted from the maximum temperature variation to determine a range of the temperature variation. An example of this embodiment is shown in FIG. 11, where line 114 shows the temperature range from the example shown in FIG. 9. The low, i.e. close to zero, "noise" areas 115 of the graph shown in FIG. 11 indicate the drum rotation has stopped. Therefore, the temperature range 114 at any given time can be compared to the threshold value 112, whereby the drum 28 is determined to not be rotating if the temperature range 114 is below the threshold value 112 and the drum 28 is determined to be rotating if the temperature range 114 is at or above the threshold value 112.

To increase the robustness of the drum state determination, a delay can be added such that the temperature variation 110 or temperature range 114 must be below the threshold value 112 for a predetermined period of time or number of consecutive samples. This would help protect against false determinations of drum non-movement. For example, delay of 10 seconds or 10 is a reasonable amount of time to detect an actual drum non-movement.

A method according to one embodiment of the invention may be based at least in part on the concepts shown in FIGS. 9-11, and may use temperature readings from the IR sensor 70 to determine non-movement of a load of laundry in the clothes dryer 10. When the load of laundry is non-moving, it may be assumed that the drum 28 is not rotating. Therefore, the method may also be considered to be a method for determining if the drum 28 is rotating. The method may be incorporated into a cycle of operation for the clothes dryer 10 and may be carried out by the controller 14 using information from the IR sensor 70.

Initially, the drive unit, which includes the motor 64, is operated to cause a rotation of the drum 28. A plurality of temperature readings are taken over time of the load of laundry with the IR sensor 70 while the drive unit is being operated. The drum 28 may be rotated at a rotational speed to tumble the load of laundry within the treating chamber 34. If heated air is supplied, it may be provided for a time sufficient for the load of laundry to reach a uniform temperature. This may be done prior to taking any temperature readings.

A temperature variation in the plurality of temperature readings may then be determined. The temperature variation may be the difference between at least two of the temperature readings. Alternatively, the difference between multiple temperature readings may be determined to form multiple difference values. Determining the temperature variation may include determining an average of the difference values. The average can be determined from an average of the absolute values of the difference values. The temperature variation may also be determined as described for FIGS. 10 and 11. While FIG. 11 specifically shows a temperature range, the temperature range is considered to be a temperature variation for the purposes of this method.

From the temperature variation, the movement state of the load of laundry can be assessed, and a movement or a non-movement of the load of laundry can be determined. The movement state can be assessed by comparing the temperature variation to a temperature variation threshold. For example, the temperature variation threshold may be the threshold value 112 of FIGS. 10 and 11. If the temperature variation satisfies the temperature variation threshold, the load of laundry is concluded to be non-moving; therefore, the drum 28 is not rotating.

The method may further include ceasing operating of the drive unit upon a determination of non-movement of the load of laundry. An indication of an error in the clothes dryer 10 may be given, such as by showing a visual indicator in the user interface 16 or by emitting an audible alarm.

Figure 12:
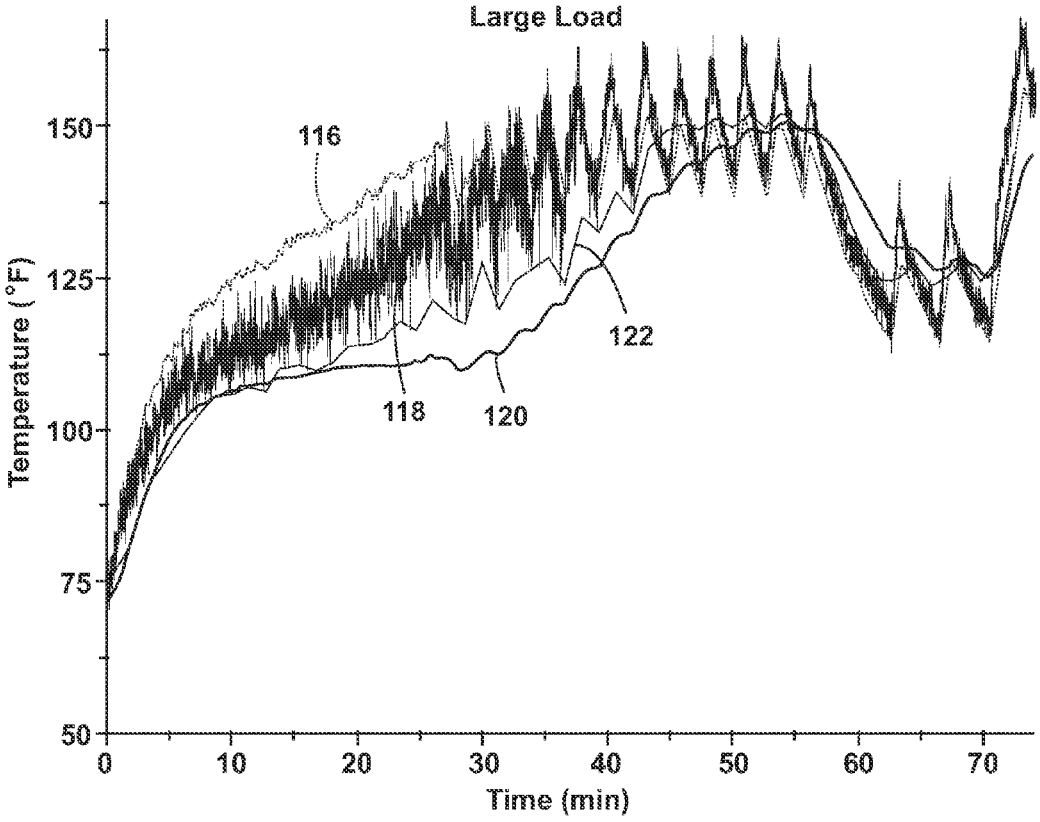
FIGS. 12 and 13 are graphs comparing the exhaust air temperature, the IR temperature, and the actual temperature over time for a large load of laundry and a small load of laundry, respectively during a cycle of operation in a clothes dryer.
Figure 13:
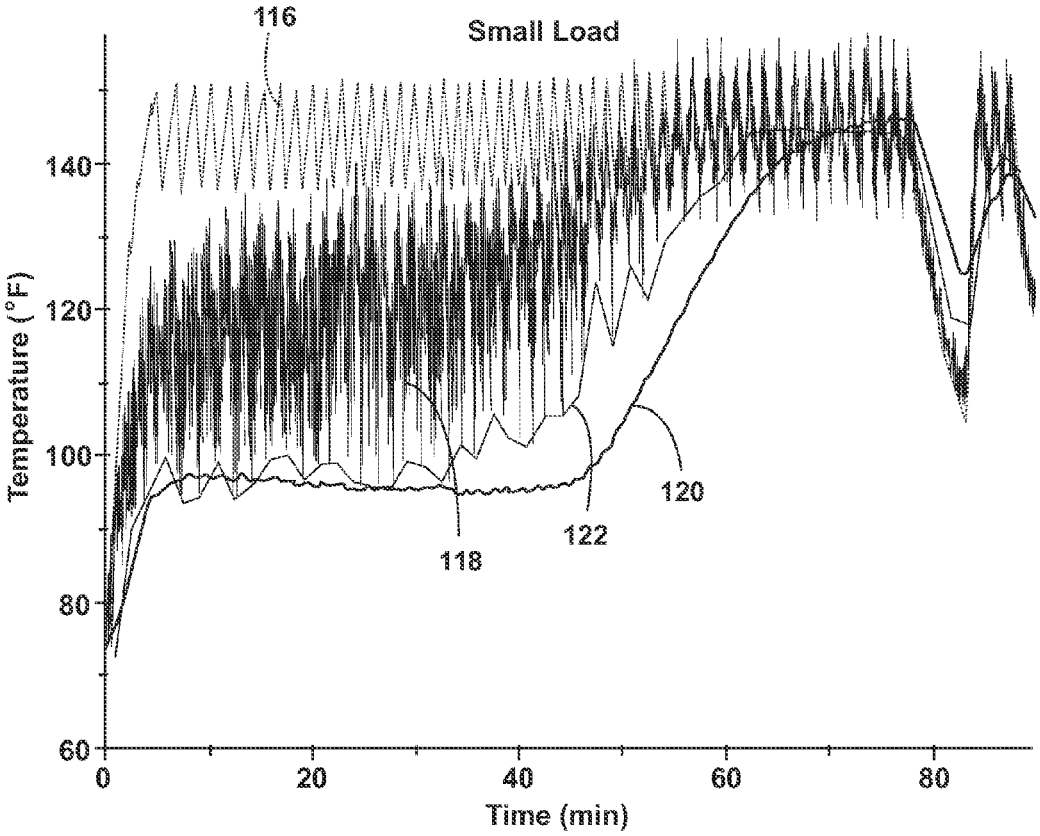

In another embodiment, temperature readings from the IR sensor 70 can be used to determine or estimate an actual temperature of the load of laundry. FIGS. 12 and 13 show graphs of temperature over time for a large load of laundry and a small load of laundry, respectively, during a cycle of operation in the clothes dryer 10, wherein the temperature is measured in several different ways. While the graphs are compiled using example data from a large load consisting of nine lbs of towels and a small load consisting of two lbs of towels, other loads having varying sizes, fabrics and compilations of articles follow the same general pattern.

In each graph, line 116 represents the exhaust air temperature, and is measured by a sensor (not shown) located in the exhaust air path, such as in exhaust conduit 44. Some conventional clothes dryers use the exhaust air temperature to approximate the temperature of the load. Line 118 represents the IR temperature of the load of laundry measured by the IR sensor 70. Line 120 represents the average temperature of the load of laundry measured by sensors (not shown), such as iButtons, attached to each article of the load of laundry. A lower temperature boundary, represented by line 122, can be created for the IR temperature 118. The lower temperature boundary 122 is determined from the minimum values of IR temperature 118. The lower temperature boundary 122 may be determined in the same fashion discussed above for the lower envelope 76 shown in FIG. 6.

The average temperature 120 is assumed to most accurately represent the actual temperature of the load of laundry, since it is measured by individual sensors on each article of laundry. However, an implementation of this type of temperature measurement is not practical for every-day use, since it would require each article of laundry to be provided with a temperature sensor. Using an exhaust air temperature sensor or the IR sensor 70 is a more reasonable type of temperature measurement since only once sensor is needed and is installed in the clothes dryer 10 and not on the articles making up the load. It can be observed that the IR temperature 118 is closer to the average temperature 120 than the exhaust air temperature 116. Further, the lower temperature boundary 122 is closer to the average temperature 120 than either the IR temperature 118 or the exhaust air temperature 116. Therefore, it can be concluded that the lower temperature boundary 122 of the IR temperature 118 is the best practical estimation of the actual temperature of the load.

A method according to another embodiment of the invention may be based at least in part on the concepts shown in FIGS. 12-13 and may use temperature readings from the IR sensor 70 to estimate the actual temperature of a load of laundry in the clothes dryer 10. Initially, a plurality of temperature readings of the load of laundry may be taken over time with the IR sensor 70 while the drum 28 is rotated. The drum 28 may be rotated at a rotational speed to tumble the load of laundry within the treating chamber 34. If heated air is supplied, it may be provided for a time sufficient for the load of laundry to reach a uniform temperature. This may be done prior to taking any temperature readings.

A lower temperature boundary can then be determined from the plurality of temperature readings. The temperature readings may be taken at a predetermined sampling rate to form a plurality of consecutive temperature values. Determining the lower temperature boundary may comprise determining the lowest few of the plurality of consecutive temperature values. The lower temperature boundary may be determined by monitoring the temperature values within a window of time based on a predetermined period, and the lowest value in the window is used as a data point for the lower temperature boundary. This may be done for several windows of time to define multiple data points for the lower temperature boundary. The predetermined period for the window may be adjustable.

An actual temperature of the load of laundry can be estimated based on the lower temperature boundary. In some cases, the lower temperature boundary itself can be assumed to be the actual temperature. In other cases, the average of the lower temperature boundary over a predetermined period of time may be determined and assumed to be the actual temperature.

While the invention has been specifically described in connection with certain specific embodiments thereof, it is to be understood that this is by way of illustration and not of limitation, and the scope of the appended claims should be construed as broadly as the prior art will permit. For the methods described herein, the sequence of steps described is for illustrative purposes only and is not meant to limit the methods in any way as it is understood that the steps may proceed in a different logical order, additional or intervening steps may be included, or described steps may be divided into multiple steps, without detracting from the invention. It should also be noted that all elements of all of the claims may be combined with each other in any possible combination, even if the combinations have not been expressly claimed.

What is claimed is:

1. A method for controlling the operation of a clothes dryer having a controller in which is stored a cycle of operation and its operating parameters, and which is operably coupled to multiple components of the clothes dryer to control the operation of the components to execute the cycle of operation, with the components comprising at least a rotatable drum defining a treating chamber and an infrared temperature sensor directed toward the treating chamber, the method comprising:

rotating the drum with a load of laundry in the treating chamber;

taking a plurality of temperature readings over time of the load of laundry with the infrared sensor while the drum is rotating;

processing the plurality of temperature readings to form an upper envelope of the temperature readings and a lower envelope of the temperature readings;

determining a temperature variation by repeatedly determining a difference between the upper envelope and the lower envelope;

determining a characteristic of the load of laundry based on the temperature variation; and controlling the operation of the clothes dryer based on the determined characteristic.

2. A method for controlling the operation of a clothes dryer having a controller in which is stored a cycle of operation and its operating parameters, and which is operably coupled to multiple components of the clothes dryer to control the operation of the components to execute the cycle of operation, with the components comprising at least a rotatable drum defining a treating chamber and an infrared temperature sensor directed toward the treating chamber, the method comprising:

rotating the drum with a load of laundry in the treating chamber;

taking a plurality of temperature readings over time of the load of laundry with the infrared sensor while the drum is rotating;

determining a temperature difference in the plurality of temperature readings, wherein the temperature difference is the difference between a maximum temperature reading and a minimum temperature reading of the plurality of temperature readings within a window of time;

determining a temperature variation by repeatedly determining the temperature difference for different windows of time;

determining a characteristic of the load of laundry based on the temperature variation; and controlling the operation of the clothes dryer based on the determined characteristic.

* * * * *